US010405645B1

(12) United States Patent
Liu et al.

(10) Patent No.: US 10,405,645 B1
(45) Date of Patent: Sep. 10, 2019

(54) FOLDING TABLE

(71) Applicant: Zhuhai Shichang Metals Ltd., Zhuhai (CN)

(72) Inventors: JingBo Liu, Zhuhai (CN); Che-Jen Wang, Zhuhai (CN)

(73) Assignee: Zhuhai Shichang Metals Ltd., Zhuhai (CN)

( * ) Notice: Subject to any disclaimer, the term of this patent is extended or adjusted under 35 U.S.C. 154(b) by 14 days.

(21) Appl. No.: 15/969,824

(22) Filed: May 3, 2018

(51) Int. Cl.
*A47B 3/00* (2006.01)
*A47B 3/087* (2006.01)
*A47B 3/08* (2006.01)

(52) U.S. Cl.
CPC ..... *A47B 3/087* (2013.01); *A47B 3/0818* (2013.01); *A47B 2003/0821* (2013.01)

(58) Field of Classification Search
CPC ..... A47B 3/087; A47B 3/0818; A47B 2003/0821; A47B 3/0912; A47B 3/088; A47B 83/0911; A47B 13/06
USPC ..... 108/166, 167, 169, 171, 174, 129, 131, 108/132, 160, 126, 130, 133, 901
See application file for complete search history.

(56) References Cited

U.S. PATENT DOCUMENTS 7,703,402 B2 * 4/2010 Larcom ..... A47B 3/0815 108/132
7,707,948 B2 * 5/2010 Lin ..... A47B 3/08 108/115
7,707,949 B2 5/2010 Larcom et al.
7,757,617 B2 * 7/2010 Larcom ..... A47B 3/0815 108/132
9,273,720 B2 * 3/2016 Tsai ..... F16C 11/10
9,750,339 B2 * 9/2017 Turner ..... A47B 3/083
2005/0005826 A1 * 1/2005 Strong ..... A47B 3/087 108/132
2006/0196395 A1 * 9/2006 Lin ..... A47B 3/08 108/132
2014/0116301 A1 * 5/2014 Tsai ..... A47B 3/087 108/169
2016/0316904 A1 * 11/2016 Harper ..... A47B 3/087

FOREIGN PATENT DOCUMENTS

CA 2367217 * 7/2002

* cited by examiner

*Primary Examiner* — Janet M Wilkens
(74) *Attorney, Agent, or Firm* — Ludeka Neely Group, P.C.

(57) ABSTRACT

A tabletop having a first half and a second half that rotate about a central axis between an extended position and a storage position. The table includes a hinge disposed between first and second beams attached to the underside of the tabletop adjacent to the central axis. A first support rod is rotatably attached to the underside of the tabletop and has a proximal end attached to a first leg and a distal end having at least two first fingers projecting therefrom. A second support rod is rotatably attached to the underside of the tabletop and has a proximal end attached to a second leg and a distal end having one or more second fingers projecting therefrom. Upon rotation of the first and second legs between extended and collapsed positions, the at least two first fingers engage and disengage with the one or more second fingers.

18 Claims, 4 Drawing Sheets

FOLDING TABLE

TECHNICAL FIELD

The disclosure is directed to tables and in particular to folding tables and hinge mechanisms therefor.

BACKGROUND AND SUMMARY

Many different types of tables are well known and used for a variety of different purposes. For example, conventional tables may include legs that are pivotally attached to a tabletop and the legs may be movable between a use position in which the legs extend outwardly from the tabletop and a storage position in which the legs are collapsed against the tabletop. The conventional tables may be rectangular, square, oval, or round. Relatively large rectangular or round tables are difficult for one person to move even with the legs collapsed against the underside of the tabletop.

Tables that can be folded in half for storage are less bulky than the non-folding tables and can be more easily handled by one person. Also, the foldable tables may be more readily maneuvered around objects and more easily stored in closets or other limited storage locations. However, foldable tables are typically less rigid in the unfolded use position and/or may require a more robust hinge that prevents a central folding area of the table from sagging during use.

When moving an unfolded table, there is a tendency for the foldable table to unintentionally fold. Accordingly, what is needed is a robust hinge mechanism for a folding table that prevents the table from sagging or folding in the use position and that does not hinder the folding of the table when the table is ready for storage.

In view of the foregoing, embodiments of the disclosure provide a table that includes a tabletop having a first half and a second half. The first half and the second half rotate about a central axis to move between a use position and a storage position. A first support beam is attached to an underside of the first half of the tabletop adjacent to the central axis. A second support beam is attached to an underside of the second half of the tabletop adjacent to the central axis. A hinge is disposed between the first support beam and the second support beam. A first support rod is rotatably attached to the underside of the first half of the tabletop. The first support rod has a proximal end and a distal end having two or more first fingers projecting therefrom. A second support rod is rotatably attached to the underside of the second half of the tabletop. The second support rod has a proximal end and a distal end having one or more second fingers projecting therefrom. A first leg is attached to the proximal end of the first support rod. The first leg is operable to rotate with the first support rod from an extended position to a collapsed position. A second leg is attached to the proximal end of the second support rod. The second leg is operable to rotate with the second support rod from an extended position to a collapsed position. Upon rotation of the first and second legs to the extended position, the two or more first fingers engage and intermesh with the one or more second fingers through the hinge to prevent rotation of the first half of the tabletop relative to the second half of the tabletop about the central axis, thereby locking the first and second tabletop halves in the use position. Upon rotation of the first and second legs to the collapsed position, the two or more first fingers disengage from the one or more second fingers through the hinge to permit rotation of the first half of the tabletop relative to the second half of the tabletop about the central axis, thereby allowing the first and second tabletop halves to be rotated to the storage position.

In another embodiment there is provided a tabletop having a first half and a second half, wherein the first half and the second half rotate about a central axis to move between a use position and a storage position. The tabletop includes a hinge having a first tubular section and a second tubular section. The first tubular section is attached to a first support beam. The first support beam is attached to an underside of the first half of the tabletop adjacent to the central axis. The second tubular section is attached to a second support beam. The second support beam is attached to an underside of the second half of the tabletop adjacent to the central axis. The first tubular section is joined by a hinge pin to the second tubular section. A first leg is attached to a first rotatable support rod. The first rotatable support rod has a proximal end attached to a first leg and a distal end disposed through the first support beam and through the first tubular section of the hinge. The distal end has at least two spaced-apart fingers projecting therefrom. A second leg is attached to a second rotatable support rod. The second rotatable support rod has a proximal end attached to a second leg and a distal end disposed through the second beam and through the second tubular section of the hinge. The distal end has one or more fingers projecting therefrom for engaging and disengaging with the at least two spaced-apart fingers of the first rotatable support rod when the first and second legs are rotated between the use position with the first and second legs extended from the tabletop and the storage position with the first and second legs collapsed toward the tabletop.

In some aspects the hinge is a tubular hinge through which the first and second support rods engage one another when the first and second legs are in the extended position. In other aspects, the hinge includes a hinge pin joining a first tubular hinge section to a second tubular hinge section. The hinge pin is parallel with the central axis and is perpendicular to the first and second support rods, so that when the first and second legs are in the extended position, the hinge pin is adjacent to the intermeshed first and second fingers of the first and second support rods. In still other aspects the hinge rotates about a hinge axis defined by the hinge pin.

In some aspects the two or more first fingers include a pair of spaced-apart fingers, the one or more second fingers include a single finger. In other aspects, the spaced-apart fingers define a groove, wherein the groove is parallel to the hinge axis when the first and second legs are in the extended position, and the groove is perpendicular to the hinge axis when the first and second legs are in the collapsed position.

In some aspects the table further includes a first crossbar attached to the underside of the first half of the tabletop distal from the first support beam and a second crossbar attached to an underside of the second half of the tabletop distal from second support beam.

In still other aspects, the table further includes a first articulated bracket attached to the first leg and to the first crossbar for locking the first leg in the extended position, and a second articulated bracket attached to the second leg and to the second crossbar for locking the second leg in the extended position.

In other aspects, the table further includes a first clip connected to the first support rod to engage the second support rod to secure the table in the storage position, and a second clip connected to the second support rod to engage the first support rod to secure the table in the storage position.

An advantage of the design of the foldable table according to the disclosure is that the hinge mechanism provides positive locking of the table in a use position when the legs are fully extended and enables easy folding of the table for storage when the legs are collapsed toward the underside of the table. The hinge mechanism is also designed to support tabletop halves in the use position so that a central portion of the table does not sag. Other features and advantages may be evident from the drawings and detailed description provided herein.

BRIEF DESCRIPTION OF THE DRAWINGS

The appended drawings contain figures useful for further illustration and clarification of the above and other aspects, advantages and features of the disclosed embodiments. It will be appreciated that these drawings depict embodiments of the disclosure and are not intended to limit the scope of the disclosed embodiments. The disclosed embodiments will be described and explained with additional specificity and detail through the use of the accompanying drawings in which.

DETAILED DESCRIPTION OF THE EMBODIMENTS

The present disclosure is generally directed to foldable tables. However, the hinge mechanism may be adapted to be used with other types of furniture or structures.

Figure 1:
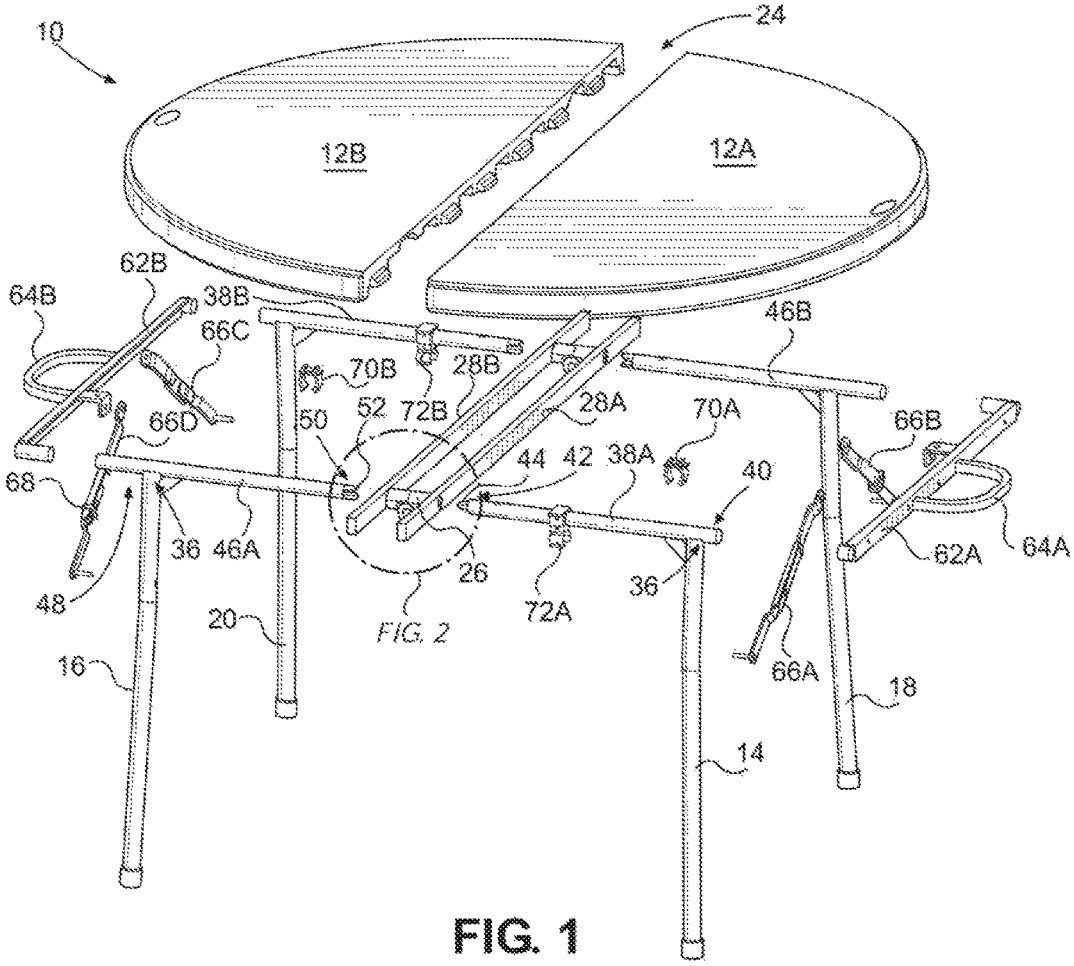
FIG. 1 is an upper perspective exploded view, not to scale, of an exemplary table, illustrating a tabletop in an unfolded position and legs in an extended or use position.

As shown in FIG. 1, a table 10 may include a tabletop 12 and one or more legs 14, 16, 18, 20 that may be sized and configured to support the tabletop sections 12A and 12B in a use position. The legs 14-20 may have a fixed length or may be adjustable to provide an adjustable height table 10.

Figure 2:
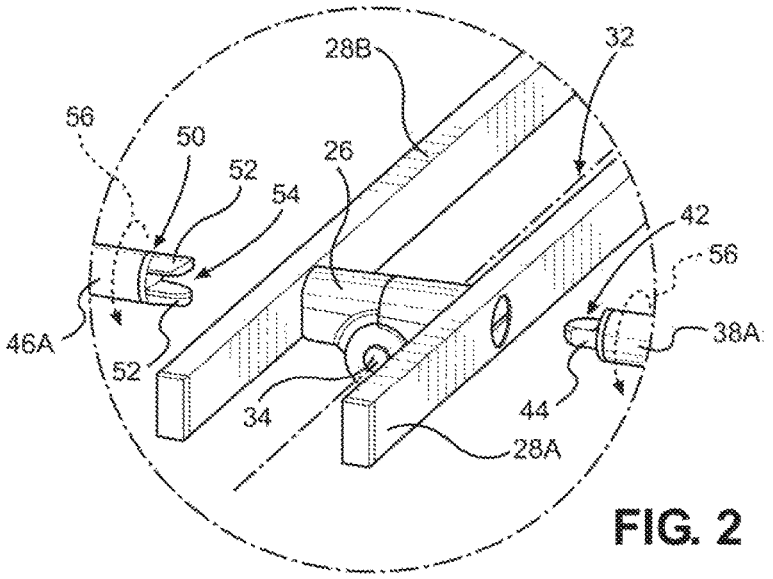
FIG. 2 is a partial perspective exploded view, not to scale, of a hinge mechanism for the table of FIG. 1 with support rods rotated in the use position.

A key feature of the disclosure is a hinge mechanism 22, shown in more detail in FIG. 2. The hinge mechanism 22 is specifically designed to positively lock the table 10 in a use position with the legs 14-20 extended and to enable the table 10 to be unlocked and folded into a storage position with the tabletop sections 12A and 12B folded together.

As described above, a further advantage of the hinge mechanism 22 is that the hinge mechanism 22 is designed to prevent the tabletop sections 12A and 12B from sagging in a seam 24 where the two sections 12A and 12B meet.

Figure 3:
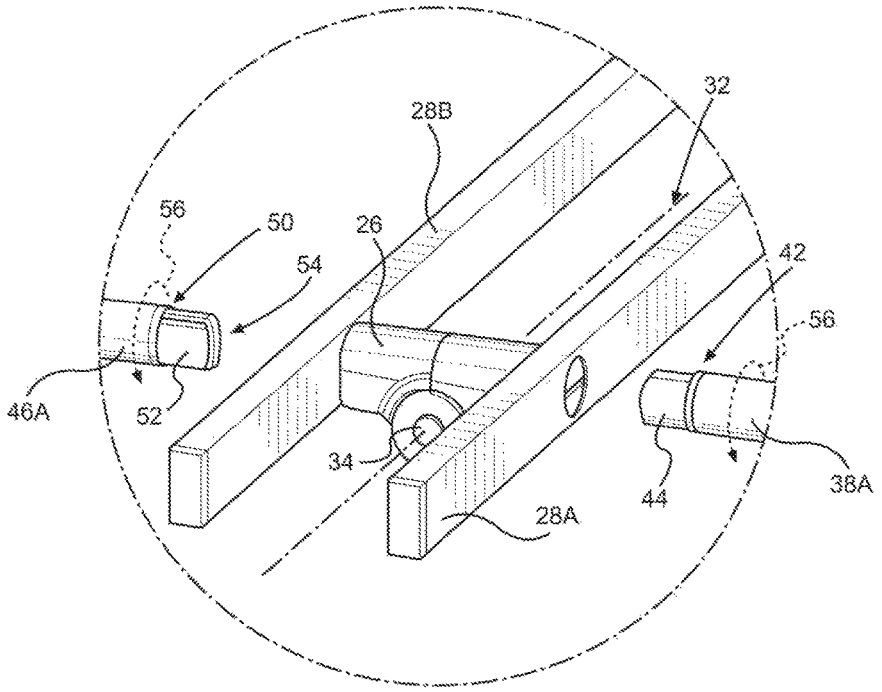
FIG. 3 is a partial perspective exploded view, not to scale, of a portion of the hinge mechanism of FIG. 2 with support rods rotated in a storage position.

With reference to FIGS. 2 and 3, the hinge mechanism 22 is shown in an exploded view, not to scale, in the use position (FIG. 2) and in the storage position (FIG. 3). Specifically, the hinge mechanism 22 includes a tubular hinge 26 disposed between a pair of support beams 28A and 28B. The support beams 28A and 28B are attached to an underside 30 of the table adjacent to the seam 24. The support beams 28A and 28B are connected to one another by the tubular hinge 26. The tubular hinge 26 rotates about an axis 32 on a hinge pin 34. The hinge pin 34 is parallel to the support beams 28A and 28B and provides an axis of rotation for the tabletop sections 12A and 12B.

Leg 14 is attached at its upper end 36 to a first rotatable support rod 38 having a first end 40 attached to the leg 14 and a second end 42 terminating in a single finger 44. Leg 16 is attached at its upper end 36 to a second rotatable support rod 46 having a first end 48 attached to the leg 16 and a second end 50 terminating in a pair of fingers 52. In the use position, the finger 44 and the pair of fingers 52 intermesh with one another so that a groove 54 between the pair of fingers 52 is substantially parallel with the hinge pin 34 and the intermeshed finger 44 and pair of fingers 52 are disposed in contact with the hinge pin 34 to prevent the tubular hinge 26 from rotating about the hinge pin 34.

Figure 4:
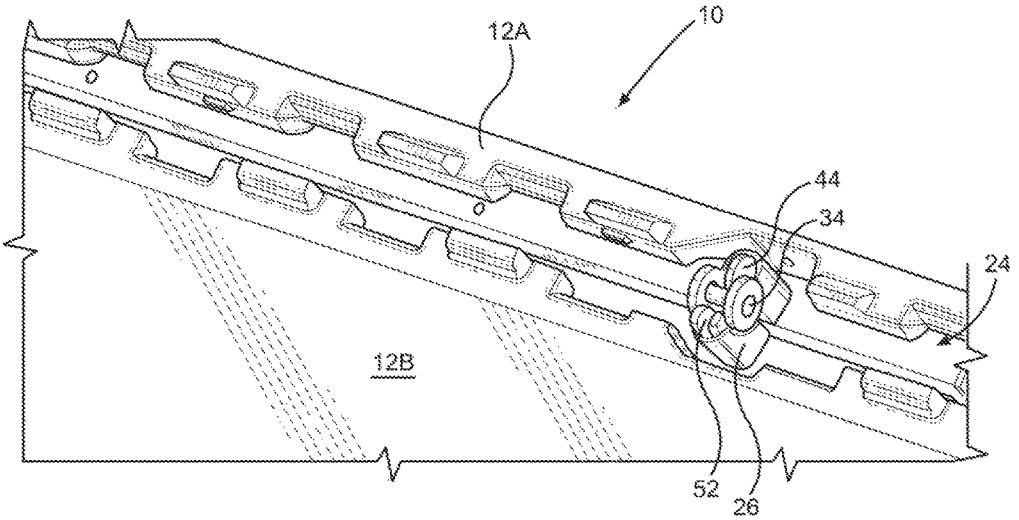
FIG. 4 is a partial perspective view, not to scale of a seam portion of the foldable table of FIG. 1, with the table in the storage position.

When it is desired to fold the table 10 into a storage position, the support rods 46 and 38 are rotated in the direction of arrows 56 so that the groove 54 between the pair of fingers 52 is substantially perpendicular to the hinge pin 34 thus enabling the tubular hinge 26 to rotate about the hinge pin 34 and disengage the finger 44 from the pair of fingers 52 as shown in FIG. 4. It will be appreciated that the tubular hinge 26 is operable to rotate only about axis 32 and is otherwise fixedly attached to support beams 28A and 28B. Accordingly, only the support rods 38A-38B and 46A-46B rotate within the tubular hinge 26 to allow the table to fold and to prevent the table 10 from folding. There is only a single rotational direction of the hinge 26 relative to the tabletop 12A and 12B. The axis of rotation of the hinge 26 is parallel to the seam 24 of the table 10 and there is no rotation of the hinge 26 on an axis perpendicular to the seam 24 of the table 10. Accordingly, a central portion of the table 10 adjacent to the seam 24 may be more fully supported by support beams 28A and 28B, thereby preventing the central portion of the table 10 from sagging during use.

Figure 5:
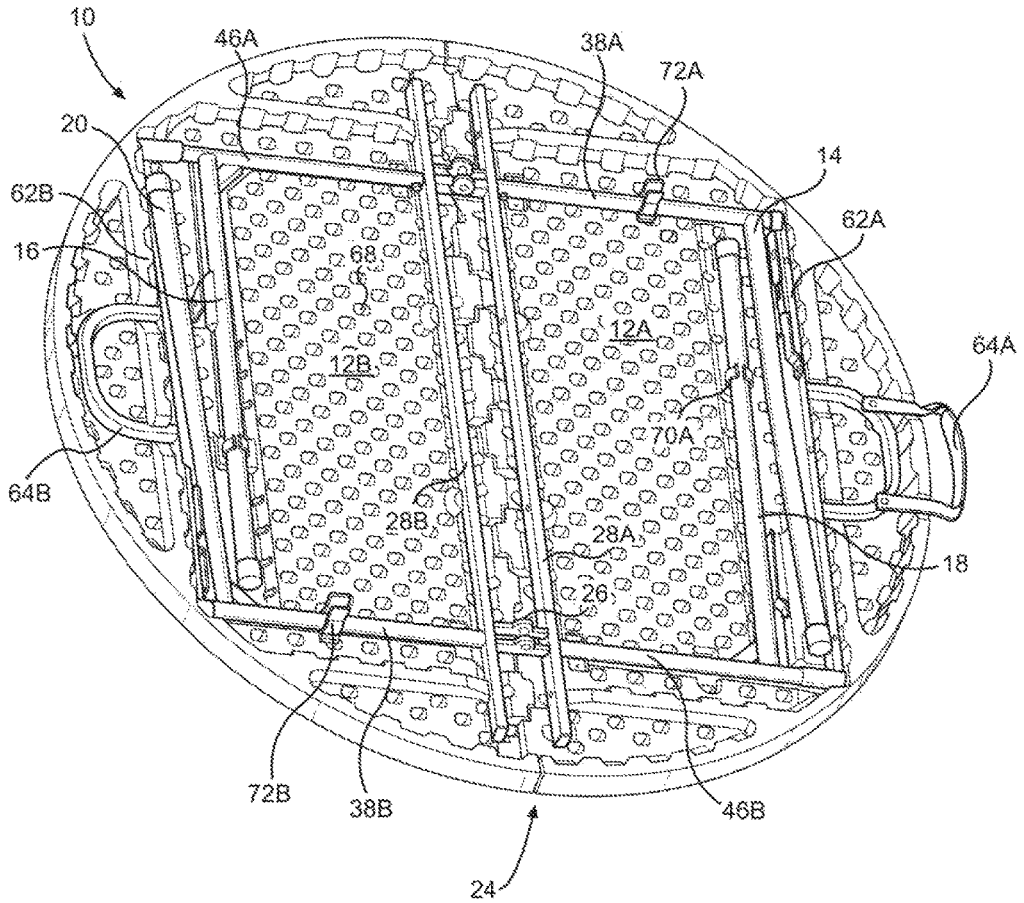
FIG. 5 is an underside perspective view, not to scale, of the table shown in FIG. 1, illustrating the legs in a collapsed or storage position.
Figure 6:
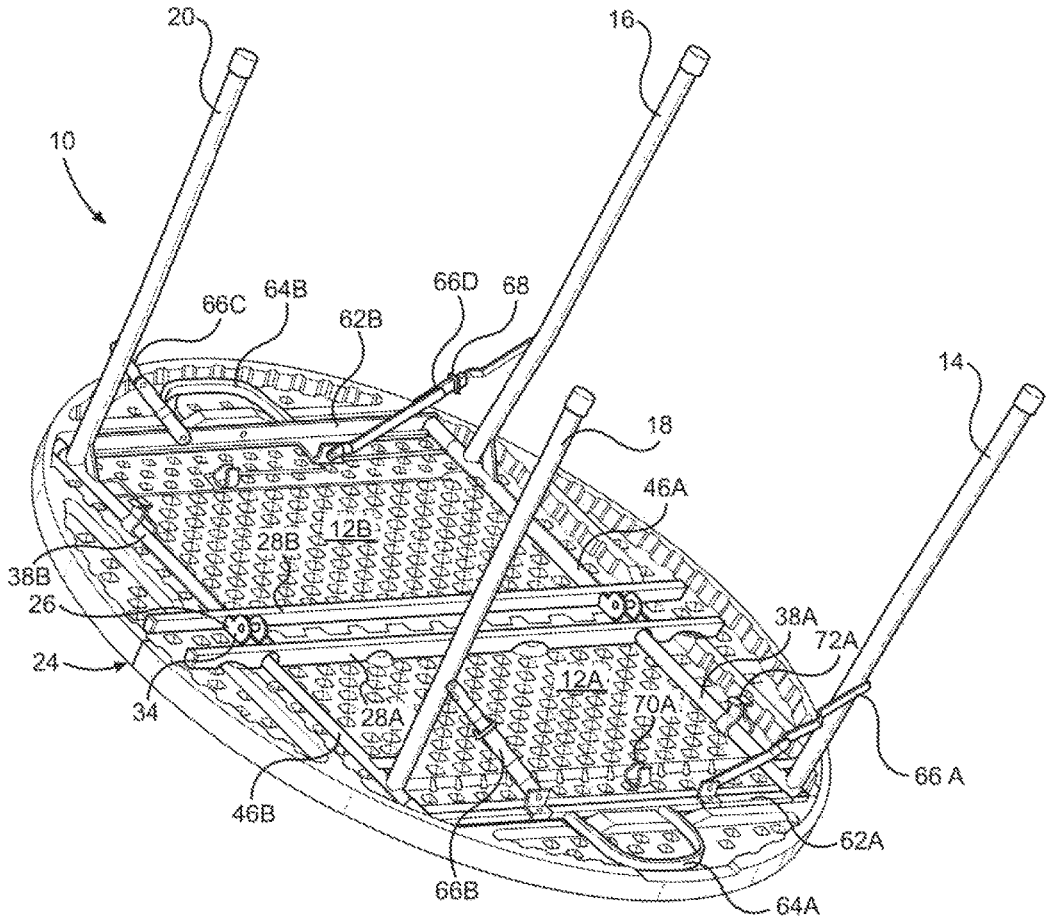
FIG. 6 is an underside perspective view, not to scale, of the table shown in FIG. 1, illustrating the legs in a use position.

The table 10 in the storage position is shown in perspective view in FIG. 5 with the legs 14-20 collapsed against the underside 30 of the table 10 so that the legs 14-20 are substantially parallel to one another. In the storage position, the table 10 may be stored in a relatively compact area and may be more easily moved by one person. The table in the use position is shown in perspective view in FIG. 6 with the legs 14-20 in a fully extended upright position. In the fully extended upright position, the legs 14, 16, 18, 20 may be disposed perpendicular to the table 12A-12B, or the legs 14-20 may be at an oblique angle relative to the tabletop 12A-12B, which may help provide a wider base when the legs are in the use position.

With reference again to FIG. 1, a leg locking mechanism may be provided for locking the legs in the use position. The leg locking mechanism includes a first crossbar 62A attached to the underside 30 of the tabletop 12A distal from the first support beam 28A and a second crossbar 62B attached to the underside 30 of the tabletop 12B distal from second support beam 28B. In one embodiment, handles 64A and 64B may be attached to the crossbars 62A and 62B to aid in moving the table 10 to a storage location. The leg locking mechanism further includes an articulated bracket 66A-66D attached to a leg 14-20 as shown and to the crossbars 62A and 62B. The articulated brackets 66A-66D are well known in the art and may include devices such as a locking ring 68 to prevent the articulated brackets 66A-66D and thus legs 14-20 from collapsing.

Leg clips 70A and 70B may be used to hold legs 18 and 16 in a position adjacent to the underside 30 of the table 10 when the table 10 is in the storage position. For example, leg clip 70A may be attached to the underside 30 of the table 20 and may clamp onto leg 18 when leg 18 is collapsed against the underside 30 of the table 10. Likewise, leg clip 70B may be attached to the underside 30 of the table 10 and may clamp onto leg 16 when leg 16 is collapsed against the underside 30 of the table 10.

When the table 10 is in the storage position as shown in FIG. 5, crossbar clip 72A may be attached to the underside 30 of the table 10 and may be clamped onto crossbar 46A and crossbar clip 72B may be attached to the underside 30 of the table and may be clamped onto crossbar 46B to restrain tabletop 12A from unfolding relative to tabletop 12B. Thus, the undersides 30 of tabletop 12A and tabletop 12B may be parallel to one another when the table 10 is in the storage position.

When the table is an unfolded position as shown in FIG. 5, the finger 44 is intermeshed with the pair of fingers 52 so that movement of leg 14 causes rotation of support rod 38A which simultaneously causes rotation of support rod 46A. Likewise, movement of leg 18 causes rotation of support rod 46B which simultaneously causes rotation of support rod 38B. Accordingly, a user need only move two legs 14 and 18 or 16 and 20 in order to fully extend the legs 14-20 to the extended position or to collapse the legs 14-20 to the storage position adjacent the underside 30 of the table. Thus, the table 10 may be more readily set up to the use position or folded to the storage position.

The table 10 may be made of a variety of materials including plastics and metals. Desirably, for weight purposes, the tabletop 12A-12B may be constructed from plastic, for example, blow-molded plastic. However, other lightweight, durable materials may be used for the tabletop 12A-12B. Various shapes for the tabletop 12A-12B may be used including rectangular, round, oval, and square. A blow-molded plastic tabletop 12A-12B is desirable since it is generally weather resistant and can be used in a wide variety of locations and environments. In addition, blow-molded plastics are durable, long-lasting and corrosion resistant and may be used to support a relatively large amount of weight. A blow-molded plastic tabletop 12A-12B is relative strong because it includes opposing walls or surfaces that are separated by a distance creating a hollow space between the walls that may be air filled or filled with a rigid foam material. The opposing walls help create a high-strength, rigid tabletop.

The legs 14, 16, 18, and 20, support beams 28A and 28B, support rods 46A and 46B, and cross bars 62A-62B may be constructed from metal, such as metal tubes. Desirably, the metal tubes may be relatively strong, yet lightweight. It will be appreciated, however, that the legs 14, 16, 18, and 20, support beams 28A and 28B, support rods 46A and 46B, and cross bars 62A-62B do not require a tubular configuration and may be constructed from other suitable materials with a variety of shapes.

The table 10 may include movable tabletop sections 12A-12B to provide a foldable table 10. However, the table 10 need not include movable sections 12A-12B and need not be foldable. In fact, the tabletop 12A-12B may have a unitary, one-piece construction formed, for example, during a blow-molding or other suitable manufacturing process. When the table is not foldable, the hinge 26 may be eliminated. However, the support rods 38 and 46 may be used to coordinate joint movement of the legs 14 and 16 or 18 and 20 without the need to rotate all four legs in order to put the table into a storage position.

It is contemplated and will be apparent to those skilled in the art from the foregoing specification and attached drawings that modifications and/or changes may be made in the embodiments of the invention. Accordingly, it is expressly intended that the foregoing are only illustrative of the preferred embodiments and are not limiting thereto and that the true spirit and scope of the present invention be determined by reference to the appended claims.

What is claimed is:

1. A table comprising:

a tabletop having a first half and a second half, wherein the first half and the second half rotate about a central axis to move between a use position and a storage position;

a first support beam attached to an underside of the first half of the tabletop adjacent to the central axis;

a second support beam attached to an underside of the second half of the tabletop adjacent to the central axis;

a hinge disposed between the first support beam and the second support beam;

a first support rod that is rotatably attached to the underside of the first half of the tabletop, the first support rod having a proximal end and a distal end having two or more first fingers projecting therefrom;

a second support rod that is rotatably attached to the underside of the second half of the tabletop, the second support rod having a proximal end and a distal end having one or more second fingers projecting therefrom;

a first leg attached to the proximal end of the first support rod, the first leg operable to rotate with the first support rod from an extended position to a collapsed position; and a second leg attached to the proximal end of the second support rod, the second leg operable to rotate with the second support rod from an extended position to a collapsed position, wherein, upon rotation of the first and second legs to the extended position, the two or more first fingers engage and intermesh with the one or more second fingers through the hinge to prevent rotation of the first half of the tabletop relative to the second half of the tabletop about the central axis, thereby locking the first and second tabletop halves in the use position, and wherein, upon rotation of the first and second legs to the collapsed position, the two or more first fingers disengage from the one or more second fingers through the hinge to permit rotation of the first half of the tabletop relative to second half of the tabletop about the central axis, thereby allowing the first and second tabletop halves to be rotated to the storage position.

2. The table of claim 1, wherein the hinge comprises a tubular hinge through which the first and second support rods engage each other when the first and second legs are in the extended position.

3. The table of claim 1, wherein the hinge further comprises a hinge pin joining a first tubular hinge section to a second tubular hinge section, wherein the hinge pin is parallel with the central axis and is perpendicular to the first and second support rods, so that when the first and second legs are in the extended position, the hinge pin is adjacent to the intermeshed first and second fingers of the first and second support rods.

4. The table of claim 3, wherein the two or more first fingers comprise a pair of spaced-apart fingers, and the one or more second fingers comprise a single finger.

5. The table of claim 4, wherein the hinge rotates about a hinge axis defined by the hinge pin.

6. The table of claim 5, wherein the spaced-apart fingers define a groove, wherein the groove is parallel to the hinge axis when the first and second legs are in the extended position, and the groove is perpendicular to the hinge axis when the first and second legs are in the collapsed position.

7. The table of claim 1, wherein the table further comprises:

a first crossbar attached to the underside of the first half of the tabletop distal from the first support beam; and a second crossbar attached to the underside of the second half of the tabletop distal from second support beam.

8. The table of claim 7, further comprising:

a first articulated bracket attached to the first leg and to the first crossbar for locking the first leg in the extended position; and a second articulated bracket attached to the second leg and to the second crossbar for locking the second leg in the extended position.

9. The table of claim 1, further comprising one or more of:

a first clip connected to the first support rod to engage the second support rod to secure the table in the storage position; and a second clip connected to the second support rod to engage the first support rod to secure the table in the storage position.

10. A tabletop having a first half and a second half, wherein the first half and the second half rotate about a central axis to move between use position and a storage position, the tabletop comprising:

a hinge having a first tubular section and a second tubular section, the first tubular section being attached to a first support beam, the first support beam being attached to an underside of the first half of the tabletop adjacent to the central axis, the second tubular section being attached to a second support beam, the second support beam being attached to an underside of the second half of the tabletop adjacent to the central axis, wherein the first tubular section is joined by a hinge pin to the second tubular section;

a first leg attached to a first rotatable support rod, the first rotatable support rod having a proximal end attached to the first leg and a distal end disposed through the first support beam and through the first tubular section of the hinge, the distal end having at least two spaced-apart first fingers projecting therefrom, and a second leg attached to a second rotatable support rod, the second rotatable support rod having a proximal end attached to the second leg and a distal end disposed through the second beam and through the second tubular section of the hinge, the distal end having one or more second fingers projecting therefrom for engaging and disengaging with the at least two spaced-apart first fingers of the first rotatable support rod when the first and second legs are rotated between the use position with the first and second legs extended from the tabletop and the storage position with the first and second legs collapsed toward the tabletop.

11. The tabletop of claim 10, wherein the hinge pin is parallel with the central axis and is perpendicular to the first and second rotatable support rods so that in the use position, the hinge pin is adjacent to the engaged first and second fingers of the first and second rotatable support rods.

12. The tabletop of claim 10, wherein the first fingers comprise a pair of spaced-apart fingers and the one or more second fingers comprise a single finger.

13. The tabletop of claim 12, wherein the hinge rotates about a hinge axis defined by the hinge pin.

14. The foldable table of claim 13, wherein the pair of spaced-apart fingers define a groove, wherein the groove is parallel to the hinge axis when the first and second legs are extended from the tabletop, and the groove is perpendicular to the hinge axis when the first and second legs collapsed toward the tabletop.

15. The tabletop of claim 10, wherein the first and second rotatable support rods rotate about a support rod axis perpendicular to the hinge axis.

16. The tabletop of claim 10, wherein the tabletop further comprises:

a first crossbar attached to the underside of the first half of the tabletop distal from the first support beam; and a second crossbar attached to an underside of the second half of the tabletop distal from second support beam.

17. The tabletop of claim 16, further comprising:

a first articulated bracket attached to the first leg and to the first crossbar for locking the first leg in the extended position; and a second articulated bracket attached to the second leg and to the second crossbar for locking the second leg in the extended position.

18. The tabletop of claim 10, further comprising one or more of:

a first clip connected to the first support rod to engage the second support rod to secure the table in the storage position; and a second clip connected to the second support rod to engage the first support rod to secure the table in the storage position.

* * * * *